US005150738A

United States Patent [19]

Nishiwaki

[11] Patent Number: 5,150,738

[45] Date of Patent: Sep. 29, 1992

[54] ROLL COVER FOR DAMPENING APPARATUS

[75] Inventor: Hiroshi Nishiwaki, Izumi, Japan

[73] Assignees: Techno Roll Co. Ltd., Osaka, Japan; Jomac, Inc., Warrington, Pa.

[21] Appl. No.: 680,096

[22] Filed: Apr. 3, 1991

[30] Foreign Application Priority Data

Apr. 9, 1990 [JP] Japan ..... 2-94458
Jan. 1, 1991 [JP] Japan ..... 3-10004

[51] Int. Cl.[5] ..... D03D 3/02

[52] U.S. Cl. ..... 139/420 R; 139/387 R; 29/120; 428/36.1

[58] Field of Search ..... 29/131, 120, 130; 101/148; 139/420 A, 420 R, 387 R; 428/36.1

[56] References Cited

U.S. PATENT DOCUMENTS 1,281,940 10/1918 Goekike .
2,084,762 9/1957 Kameda .
2,312,853 3/1943 Toland et al. .
2,345,337 3/1944 Gardner .
2,775,195 12/1956 Martin .
3,180,115 4/1965 Marshall .
3,242,554 3/1966 Raymond .
3,491,802 1/1970 Mortensen et al. ..... 139/420 R
3,926,701 12/1975 Nishiwaki .
4,400,418 8/1983 Takeda et al. ..... 29/120 X
4,531,386 7/1985 England et al. .
4,614,094 9/1986 Kakihana et al. .
4,830,907 5/1989 Sawyer et al. ..... 139/420 A X

FOREIGN PATENT DOCUMENTS 47-29649 8/1972 Japan .
47-29650 8/1972 Japan .
47-29651 8/1972 Japan .
50-33448 10/1975 Japan .
0404051 2/1934 United Kingdom .

*Primary Examiner*—Andrew M. Falik

[57] ABSTRACT

A cover is woven into a cylindrical shape with many warp yarns composed of a hydrophilic fiber and with one or several weft yarns composed of a hydrophilic fiber with a water shrinkage about 10 to 40%. This cover has a quality of rapid response for controlling the moisturizing condition of the printing surface which is designated by the difference in the weight of the cloth of the cover between a wetted condition in which the cover absorbs and stores enough water without dropping and a dry condition in which the cover is treated with a centrifugal dehydrator for 10 minutes after being wetted. The warp and weft yarns are of less than 220 denier and have a density of 20 threads per centimeter. The weight of the cloth of the cover is less than 200 g/m$^2$ and the thickness is less than 0.5 mm.

12 Claims, 2 Drawing Sheets

ROLL COVER FOR DAMPENING APPARATUS

BACKGROUND OF THE INVENTION

This invention relates to a cylindrically shaped cover for rollers in the dampening apparatus of an offset printing machine.

An offset printing machine possesses a dampening apparatus for moisturizing a printing surface of the plate cylinder.

A commonly used dampening apparatus is composed of several rollers, one of which is covered with the cylindrically shaped cover formed of hydrophilic fibers.

This kind of roller which is called a dampening roller, always stores much water on its surface.

The inventor of this invention has invented covers of the so-called molleton type for this purpose which have been disclosed in Japanese Patent Publication Numbers 47-29650, 47-29651 and 50-33448.

The molletons of the type referred to are formed of high water shrinkable rayon fibers or polyvinyl alcohol fibers so that upon shrinking when wet, they can cause the cover to adhere firmly on the roller body.

However, when it is desired to speed up the printing operation, the an intermittent water supply system of the kind in which water is intermittently supplied to the dampening roller is not suitable. For this reason a continuous water supply system in which water is continuously supplied to the dampening roller should be employed in the high speed offset printing machine.

In the continuous water supply system, the amount of water supplied is controlled by applying a doctor roller, which operates as a doctor knife, to the surface of a pickup roller for picking up water from a water pot, and then by controlling the thickness of the water film on the surface of the pickup roller.

The molleton roller, that is, the dampening roller covered with molleton, is unsuitable for the continuous water supply system because of the following difficulties.

That is, since the molleton is a porous material composed of fibers and has a very large water-holding capacity, it takes a long time for the molleton to release to the plate cylinder all of the water stored in itself, so that it is impossible to decrease immediately the amount of water on the printing surface of the plate cylinder, even though the doctor roller is driven to decrease it.

On the other hand, since it takes a long time for the molleton to absorb and store enough water to adquately supply the plate cylinder, it is impossible to increase immediately the amount of water on the printing surface of the plate cylinder, even though the doctor roller is driven to increase the amount of water being supplied.

Therefore, instead of the molleton roller, a rubber roller of which the surface is composed of rubber is used for the dampening apparatus of the continuous water supply system.

However, since the rubber roller has much poorer hydroscopic and hydrophilic qualities than the molleton roller, uneven spots called rain marks tend to appear, as water tracks along in a circumferential direction, on the water film of its surface due to the centrifugal force and the surface tension of water when the roller is rotated, and they in turn are transferred and make faults called water ghosts on the printed articles.

To solve this problem, alcohol may be added to water to reduce its surface tension. However, this solution is not desirable because the alcohol vapors are injurious to the workers' health.

Furthermore, because the rubber roller has poor hydrophilic qualities, tacky spots of ink tend to stick on its surface, which causes the uneven spots on the surface of the rubber roller and then the irregularity in the amount of water supplied to the plate cylinder, and as a result, it becomes difficult to stably produce the printed articles with high quality.

SUMMARY OF THE INVENTION

The main object of this invention is to provide a cylindrically shaped cover which is used for covering the surface of the roller disposed in the dampening apparatus of the offset printing machine, has a quality of rapid response for controlling the moisturizing condition of the printing surface, adheres to the surface of the body of the roller firmly by the shrinking of wet wefts, and forms a smooth, even and hydrophilic surface film on the body of the roller. Another object of this invention is to provide a cylindrically shaped cover which is not only of particular advantage in the continuous water supply system but also has applicability in the conventional dampening system where a water ductor roller is intermittently driven to supply water to the dampening roller.

As used in the description which follows, the expression "setting density" has reference to the number of warp yarns per centimeter of fabric width, whereas the expression "inserting density" refers to the number of weft yarns per centimeter of fabric width.

To fulfill the above object, the cover is formed into a cylindrical shape;

(1) by weaving many warps composed of a hydrophilic fiber yarn, of which the thickness is less than 220 denier, generally about 50 to 200 denier, and arranged to run continuously in the direction of the long axis of the roller with a setting density of more than 20 threads per centimeter, preferably more than 27 threads per centimeter (before wetting) and one or several wefts composed of a hydrophilic fiber yarn, of which the hydroscopic shrinkage percentile is within a range of 10 to 40% and of which the thickness is less than 220 denier, generally from about 50 to about 200 denier, and is inserted along the direction of circumference of the roller with an inserting density of more than 20 threads per centimeter, preferably more than 23 threads per centimeter (before wetting) and of the same density as or finer than the setting density of the warp;

(2) by setting up the weight of the cloth of the cover to become less than 200 $g/m^2$ (grams per square meter), generally about 70 to 130 $g/m^2$;

(3) by setting up the thickness of the cloth of the cover to become less than 0.5 mm (millimeter), preferably less than 0.3 mm; and (4) by setting up the differince in the weight of the cloth of the cover between a wet condition in which the cover absorbs and stores enough water without dropping and a dry condition in which the cover is treated with a centrifugal dehydrator for 10 minutes after wetting to become less than 100 $g/m^2$.

DESCRIPTION OF THE PREFERRED EMBODIMENT

A circular loom, which is commonly used for weaving a fire hose, may be used for weaving the cover 15 into a cylindrical shape with warps and wefts.

Of course, the cover 15 may be woven using a conventional plain loom in a reversible figured double cloth weave, that is, a full hose weave.

Cellulose group fibers such as cotton, rayon, etc., or polyvinyl alcohol fibers (vinylon fibers) are examples of hydrophilic fibers.

The hydroscopic shrinkage of vinylon fibers can be varied according to the rate of acetalization of the polyvinyl alcohol of the material.

The vinylon-multi-filament yarn and the vinylon spun yarn having the hydroscopic shrinkage of 10 to 40% are suitable for the weft.

The objectives stated above, which are accomplished in part by the establishment of the density and the thickness of the warp 13, the density and the thickness of the weft 14, and the weight and the thickness of the cloth of cover 15 are summarized as follows;

(1) to set up the moisturizing capability of the cover which may be designated by the difference in the weight of the cloth of the cover between a wet condition and a dry condition, that is, the difference between the maximum water holding capacity and the minimum water holding capacity of the cover to be less than 100 $g/m^2$;

(2) to make the surface of the cover finer and smoother, thereby to make the surface of the dampening roller smoother as if it were finished through a polishing process;

(3) to make the surface of the cover so fine and smooth that the weaving stitches can not appear on the printed articles like their afterimage by being transferred through the plate cylinder; and (4) to make the dampening roller cover as washable as a conventional rubber roller by making its surface smoother.

Figure 1:
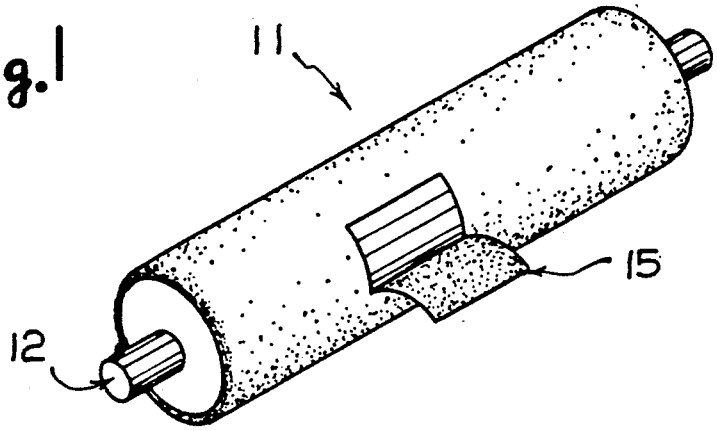
FIG. 1 is a fragmented view of a dampening roller covered with a cover formed in accordance with the present invention.
Figure 2:
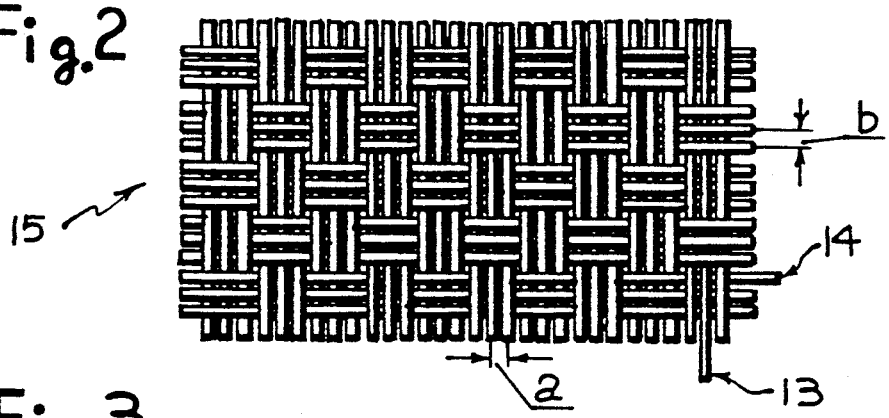
FIG. 2 is a enlarged plan view of the cloth of the cover formed in accordance with the present invention.

It is preferable for increasing the setting density of warps 13 and the inserting density of wefts 14, particularly warps 13, to weave the cover by arranging two or three threads of warps and wefts in parallel as a unit, as shown in FIG. 2.

It is preferable for this invention to set up and adjust the moisturizing capability of the cover 15, that is, the differince between the maximum water holding capacity and the minimum water holding capacity, within 20 to 70 $g/m^2$, further preferably within 30 to 60 $g/m^2$, because, in the case where the moisturizing capability is set up within 20 to 70 $g/m^2$, when the doctor roller 19 of the dampening apparatus 16 is driven to decrease the amount of water supplied transferred from the pickup roller 20 to the dampening roller 17, an amount of water from 20 to 70 $g/m^2$ is transferred quickly from the dampening roller 17 to the printing surface 21 of the plate cylinder, and consequently the amount of water stored in the dampening roller 17 decreases so quickly that water is no longer supplied to the printing surface 21.

On the other hand, when the doctor roller 19 is driven to increase the amount of water supplied transferred from the pickup roller 20 to the dampenig roller 17 when the amount of water stored in the dampening roller 17 is decreased so that the dampening roller 17 can not supply water to the printing surface 21, an amount of water 20 to 70 $g/m^2$ is quickly transferred from the pickup roller 20 to the dampening roller 17, and as a result of the transference, the dampening roller 17 is quickly brought into the condition under which it is possible to supply water to the printing surface 21.

When the moisturizing capability of the cover 15 is set up thus within 20 to 70 $g/m^2$, it becomes possible to control finely and quickly the moisturizing condition of printing surface 21 with the operation of doctor roller 19.

The moisturizing capability of the cover 15 may be set by the weight and the thickness of the cloth of the cover 15, while the weight and the thickness of the cloth of the cover 15 may be set by the thickness and the density of the warp 13 and the weft 14 in the cloth.

So the thickness and the density of the warp 13 and the weft 14 must be set so that the weight of the cloth of the cover does not exceed 200 $g/m^2$ and the thickness of the cloth of the cover does not exceed 0.5 mm, preferably 0.3 mm.

In contrast, in a conventional molleton which is used for the molleton roller in the intermittent water supply system dampening apparatus, the weight of the cloth of the cover is about 800 to 1400 $g/m^2$, the thickness of the cloth of the cover is about 2 to 3 mm, the maximum water holding capacity is about 1000 to 1500 $g/m^2$, and the minimum water holding capacity is about 700 to 1050 $g/m^2$, therefore the moisturizing capability, that is, the difference between the maximum water holding capacity and the minimum water holding capacity, is about 300 to 500 $g/m^2$.

The reason the phrases "the weight of the cloth of the cover" and "the thickness of the cloth of the covering" are used instead of the phrases "the weight of the cover" and "the thickness of the cover" is that the phrases "the weight of the cover" and "the thickness of the cover" are liable to cause misunderstanding as if they mean the weight and the thickness of the doubled two pieces of cloth which form an upper cloth and an under cloth of a reversible figured double cloth weave or a full hose weave forming the cover 15 in cylindrical shape.

So that, more exactly speaking, in this invention, the phrases "the weight of the cloth of the cover" and "the thickness of the cloth of the cover" mean the weight and the thickness of the cover when the cylindrically shaped cover 15 is cut open and spread into an unfolded piece of cloth.

According to this invention, the roller 17 has a rapid responsive nature for controlling the moisturizing condition of the printing surface.

That is, the moisturizing capability of the cover, which can be designated by the difference between the maximum water holding capacity and the minimum water holding capacity, is so little that it corresponds to the weight of conventional printing paper, i.e., 50 to 70 $g/m^2$.

And such an amount of water as stored on the surface of the dampening roller cover will be soon used up by being transferred to the printing papers or printed articles.

So that, the amount of water stored in the dampening roller 17 varies immediately by operating the doctor roller 19 or by operating the water ducter roller 24, and thereby it becomes possible to control the moisturizing condition of the printing surface 21 finely and quickly.

Further, since the weight of the cloth of the cover 15 is less than 200 g/m$^2$, the thickness of the cloth of the cover 15 is less than 0.3 mm, and the cloth is composed of hydrophilic warps 13 and wefts 14 of which the thickness is less than 200 denier, the cover 15 sticks on the surface of the body of the roller by the shrinking of wefts 14 when wetted and comes to form a smooth, even and hydrophilic surface film on the body of the roller.

Simultaneously, the cloth of the cover becomes still finer with the shrinking of wefts, as the square formations of the stitchs of cloth are turned into rectangular ones, and the density of the cloth becomes tighter than before it is wetted.

As mentioned above, since the surface of the dampening roller cover of this invention comes to form a smooth, even and hydrophilic surface film, especially in the case of the cover in which two or three threads of warps 13 and wefts 14 are arranged in parallel as a unit, as shown in FIG. 2, such uneven spots called rain marks do not appear on the water film formed on its surface as water tracks along the circumference of dampening roller, and tacky spots of ink do not stick on its surface, so that alcohol for reducing the surface tension of water becomes unnecessary, and it also becomes unnecessary to interrupt the printing operation to wash away the spots of ink from its surface.

Therefore, this invention makes it possible to avoid defects such as water ghosts and to produce a printed article with high quality efficiently with the high speed offset printing machine.

EXAMPLE

A 200 denier multifilament yarn consisting of 140 filaments (200 d/140 F) was prepared as a warp 13.

A 100 denier non-acetalized polyvinyl alcohol multifilament yarn consisting of 30 filaments (100 d/30 F) was prepared as a weft 14.

The warps 13 and the wefts 14 were woven into the cylindrical shaped cover 15 with a gingham seamless weave style with a gauge "a" between adjacent warps of 0.25 mm (density; 40 threads/cm) and with a gauge "b" between adjacent wefts of 0.25 mm (density; 40 threads/cm) by means of a plain weave loom.

The cover 15 thus woven up had the following properties; a weight of 110 g/m$^2$ in the cloth of the cover, a thickness of 0.23 mm in the cloth of the cover, a maximum water holding capacity of 110.0 g/m$^2$, a minimum water holding capacity of 53.2 g/m$^2$, a moisturizing capability of 56.8 g/m$^2$, a hydroscopic shrinkage percentile in the direction of the axis of roller of 2.5%, and a hydroscopic shrinkage percentile in the direction of circumference of roller of 29.3%.

The covers 15 were applied to the dampening rollers 17.17 in the different type of continuous water supply system dampening apparatus 16.16 in the offset printing machines of the type numbers AK2-HA432 and AKI-HA240, which were made by Akiyama Printing Machine Company in Japan, and the dampening rollers 17.17 and the metering roller 17' in the intermittent water supply system dampening apparatus 16.16 in the offset printing machines of the type number 102-VP, which were made by Heiderberg Company in Germany, and the modified type of the type number 102-VP, which were modified by the inventor of this invention.

Figure 3:
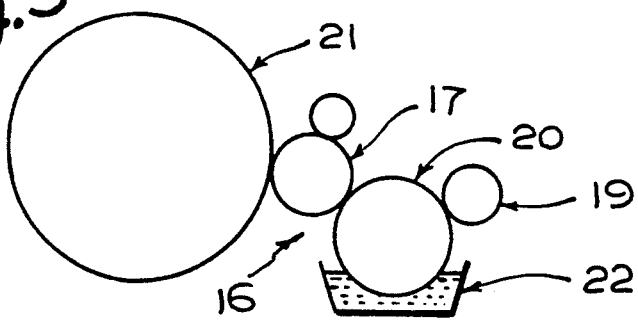
FIGS. 3 and 4 are side views of a continuous water supply system dampening apparatus disposed in the offset printing machine to which the cover is to be applied.

As shown in FIG. 3, the dampening apparatus 16 of type AK2-HA432 was composed of the dampening roller 17 touching on the plate cylinder 21, the pickup roller 20 for supplying water to the dampening roller by picking up water from the water pot 22, and the doctor roller 19 for controlling the thickness of water film on the surface of pickup roller 20 by touching on it.

Figure 4:
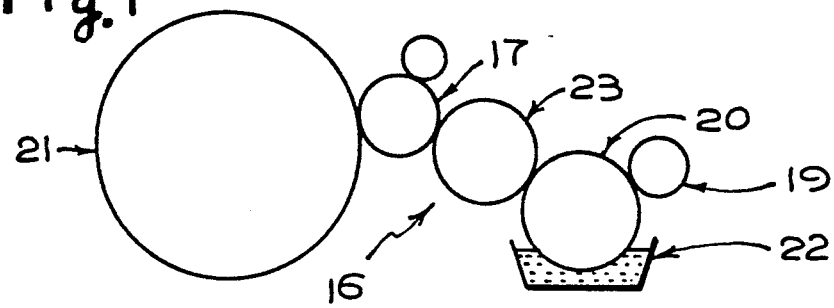

Whereas, in the dampening apparatus 16 of type AK1-HA240, the chrome roller 23 plated with chrome for transferring the water film from the pickup roller 20 to the dampening roller 17 was disposed between them, as shown in FIG. 4.

Figure 5:
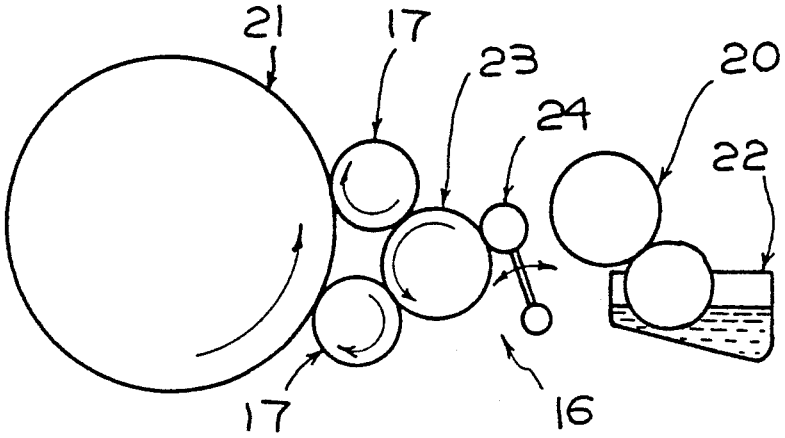
FIGS. 5 and 6 are side views of an intermittent water supply system dampening apparatus disposed in the offset printing machine to which the cover is to be applied.

The dampening apparatus 16 of type 102-VP was composed of the dampening rollers 17.17 touching on the plate cylinder 21, the pickup roller 20 for picking up water from the water pot 22, the chrome roller 23 for supplying water to the dampening rollers 17.17, and the water ductor roller 24 transferring water from the pickup roller 20 to the chrome roller 23 by intermittently reciprocating between them, as shown in FIG. 5.

Figure 6:
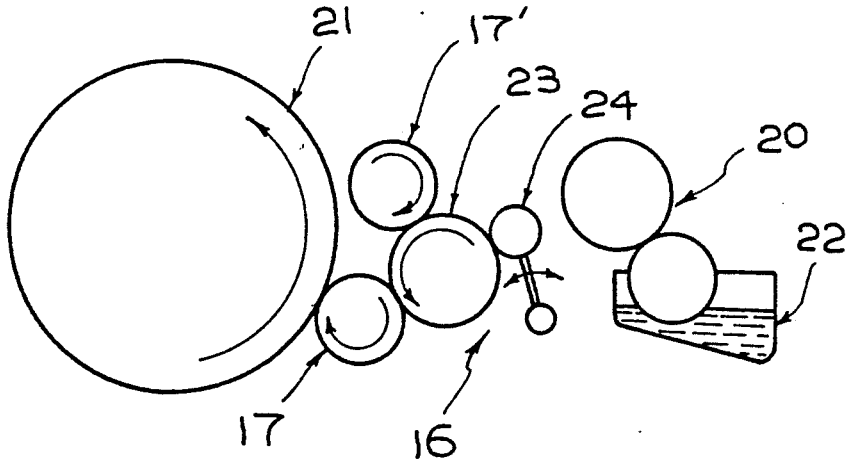

In the dampening apparatus 16 of the modified type 102-VP, the metering roller 17' was applied to control the water film on the surface of the the chrome roller 23, as shown in FIG. 6.

Those covers 15 adhered to the surface of the body of the roller firmly without any irregularities when wetted.

I claim:

1. A cylindrically shaped woven cover used for a roller in dampening apparatus of an offset printing machine is characterized in that;

(1) said cover being comprised of a multiplicity of warps, said warps being composed of a hydrophilic fiber yarn, of less than 220 denier, and arranged to run continuously in the direction of the axis of the roller with a setting density of more than 20 threads per centimeter in an unwetted state, and with one or several wefts of less than 220 denier, which are composed of a hydrophilic fiber yarn of which the hydroscopic shrinkage percentile is within 10 to 40%, said wefts having an inserting density of more than 20 threads per centimeter and of the same density as or less than said setting density of the warps before wetting;

(2) wherein the weight of a cloth of said cover is less than 200 g/m2; and (3) the thickness of said cloth of said cover is less than 0.5 mm.

2. The cover of claim 1 wherein;

(1) said warp yarn is 50 to 200 denier;

(2) said setting density of said warp yarn is more than 27 threads per centimeter;

(3) said weft yarn is 50 to 200 denier;

(4) said inserting density of said weft yarn is more than 23 threads per centimeter;

(5) said weight of the cloth of said cover is 70 to 130 g/m$^2$; and (6) said thickness of the cloth of said cover is less than 0.3 mm.

3. The cover of claim 2 wherein said difference in the weight of the cloth of the cover between a wet condition in which said cover absorbs and stores water without dropping and a dry condition is between 20 to 70 $g/m^2$.

4. The cover of claim 2 wherein said difference in the weight of the cloth of the cover between a wet condition in which said cover absorbs and stores water without dropping and a dry condition in which said covering is treated with a centrifugal dehydrator for 10 minutes after wetting is between 30 to 60 $g/m^2$.

5. The cover of claim 2 wherein the difference in the weight of the cloth of said cover between a wet condition in which said cover absorbs and stores water without dropping and a dry condition is less than 100 $g/m^2$.

6. The cover of claim 3 wherein said difference in the weight of the cloth of the cover between a wet condition in which said cover absorbs and stores water without dropping and a dry condition is between 20 to 70 $g/m^2$.

7. The cover of claim 3 wherein said difference in the weight of the cloth of the cover between a wet condition in which said cover absorbs and stores water without dropping and a dry condition in which said covering is treated with a centrifugal dehydrator for 10 minutes after wetting is between 30 to 60 $g/m^2$.

8. The cover of claim 1 wherein said weft is composed of a hydrophilic multi-filaments of which the hydroscopic shrinkage percentile is within 20 to 40%.

9. The cover of claim 4 wherein said difference in the weight of the cloth of the cover between a wet condition in which said cover absorbs and stores water without dropping and a dry condition is between 20 to 70 $g/m^2$.

10. The cover of claim 4 wherein said difference in the weight of the cloth of the cover between a wet condition in which said cover absorbs and stores water without dropping and a dry condition in which said cover is treated with a centrifugal dehydrator for 10 minutes after wetting is between 30 to 60 $g/m^2$.

11. The cover of claim 1 wherein said difference in the weight of the cloth of said cover between a wet condition in which said cover absorbs and stores water without dropping and a dry condition is between 20 to 70 $g/m^2$.

12. The cover of claim 1 wherein said difference in the weight of the cloth of the cover between a wet condition in which said cover absorbs and stores water without dropping and a dry condition is between 30 to 60 $g/m^2$.

* * * * *

UNITED STATES PATENT AND TRADEMARK OFFICE

CERTIFICATE OF CORRECTION

PATENT NO. : 5,150,738

DATED : September 29, 1992

INVENTOR(S) : Hiroshi Nishiwaki

It is certified that error appears in the above-indentified patent and that said Letters Patent is hereby corrected as shown below:

Column 6, line 53, "200 g/m2" should be --200 $g/m^2$--.

Column 7, lines 7 & 8, "covering" should be --cover--.

Column 7, lines 22 & 23, "covering" should be --cover--.

Column 1, line 27, delete "the".

Column 2, line 33, "width" should be --length--.

Column 2, line 58, "differince" should be --difference--.

Column 3, line 59, "differince" should be --difference--.

Column 4, line 44, "covering" should be --cover--.

Signed and Sealed this

Twenty-sixth Day of October, 1993

*Attest:*

Bruce Lehman

BRUCE LEHMAN

*Attesting Officer*

*Commissioner of Patents and Trademarks*